US007523880B2

(12) United States Patent
Lee et al.

(10) Patent No.: US 7,523,880 B2
(45) Date of Patent: Apr. 28, 2009

(54) SHUTTER MECHANISM FOR OPEN TYPE ICE BIN

(75) Inventors: Nam-Gi Lee, Seoul (KR); Wook-Yong Lee, Incheon (KR)

(73) Assignee: LG Electronics Inc., Seoul (KR)

( * ) Notice: Subject to any disclaimer, the term of this patent is extended or adjusted under 35 U.S.C. 154(b) by 422 days.

(21) Appl. No.: 11/363,083

(22) Filed: Feb. 28, 2006

(65) Prior Publication Data

US 2006/0202072 A1 Sep. 14, 2006

(30) Foreign Application Priority Data

Mar. 14, 2005 (KR) ..... 10-2005-0021132

(51) Int. Cl.
*B02C 19/00* (2006.01)

(52) U.S. Cl. ..... 241/65; 241/225; 241/243; 241/DIG. 17

(58) Field of Classification Search ..... 62/340; 241/65, 243, DIG. 17, 224, 225
See application file for complete search history.

(56) References Cited

U.S. PATENT DOCUMENTS

2004/0261442 A1 12/2004 Chung et al.
2005/0056043 A1 3/2005 Lee et al.
2005/0066670 A1 3/2005 Chung et al.
2005/0183441 A1 * 8/2005 Lee et al. ..... 62/340

FOREIGN PATENT DOCUMENTS

KR 10-0276738 5/2000

OTHER PUBLICATIONS

U.S. Appl. No. 11/359,476 to Jung et al., which was filed on Feb. 23, 2006.
English language Abstract of KR 10-2000-0028307.

* cited by examiner

*Primary Examiner*—Mark Rosenbaum
(74) *Attorney, Agent, or Firm*—Greenblum & Bernstein, P.L.C.

(57) ABSTRACT

An ice bin apparatus includes a case with an open upper portion for receiving pieces of ice. A guide within the case guides the received ice pieces and an auger adjacent to the guide transfers the guided ice pieces. A grinder for grinds the transferred ice pieces and a diffuser located at a bottom portion of the case discharges the ground ice. A shutter having a hinge that allows movement thereof opens or closes the diffuser for selectively discharging the ground ice therethrough, and a shutter press prevention part is capable of preventing the shutter from being pressed down during the grinding of ice pieces performed by the grinder.

12 Claims, 5 Drawing Sheets

SHUTTER MECHANISM FOR OPEN TYPE ICE BIN

BACKGROUND OF THE INVENTION

1. Field of the Invention

The present invention relates to a shutter mechanism of an open type ice bin, and more particularly, to a shutter mechanism of an open type ice bin that prevents the shutter from being undesirably pushed downward in a vertical direction during an ice grinding process performed by a grinder.

2. Description of the Conventional Art

FIG. 1 is a schematic view that illustrates a simplified structure of a refrigerator, and FIG. 2 is a cross-sectional view of the structure of conventional open type ice bin of FIG. 1, and FIG. 3 is a running mode state diagram of FIG. 2.

As illustrated in these drawings, a typical refrigerator comprises a water tank 10 that is attached to the refrigerator body for keeping a certain amount of water therein, an ice machine 30 connected to a double solenoid valve 20 which is interposed at a first outlet 11 of the water tank 10 and including an ice making mold 31 that is used to make ice, an ice bin 40 that is connected to the ice making mold 31 for storing the made ice and grinding the stored ice prior to dispensing, and a dispenser 50 that externally discharges the ice from the ice bin 40 through an outlet thereof, and further externally discharges the water stored in the water tank 10 through a second outlet 12 thereof.

The double solenoid valve 20 comprises an ice making valve (not shown) and a dispenser valve (not shown). As mentioned above, the ice making valve supplies water to the ice making mold 31 by opening the valve when ice making is necessary, and the dispenser valve discharges the supplied water to the dispenser 50 by lowering the temperature of the supplied water upon passing through the water tank 10 and thus opening it according to the user's need.

The ice bin 40 comprises a case 41 with an upper portion that is open (or can be opened) to allow a flow of ice (e.g., ice cubes, pieces of ice, etc.) to enter and has a diffuser 41*a* at a bottom portion thereof used for externally discharging the ice; an auger 44 positioned within the case 41 for transferring the flow of ice; guides 42*a*, 42*b* for guiding the transferred ice; a grinder 43 for grinding the ice guided by guides 42*a*, 42*b*; and a shutter 45 that opens and closes the diffuser 41*a* for selectively discharging the ice from the case 41.

One part of the case 41 is formed to be rectangular, and the grinder 43 is located at the center of the bottom of the case 41. The guides 42*a*, 42*b* are inclined "downward" towards the grinder 43 (positioned at the center of the case 41) and formed to be extended from both side sections of the case 41. The grinder 43 and the guides 42*a*, 42*b* are arranged at a fixed distance (namely, there is a gap therebetween) to allow the ice cubes to be ground up as they fall into the grinder 43.

The grinder 43 comprises a rotating blade 43*a* having the same axis with the auger 44, and a fixed blade 43*b* being fixed and arranged in a perpendicular manner (at a right angle) with the bottom surface of the case 41, and wherein multiple blade portions. 43*c* that are curved inwardly (as shown in FIGS. 2 and 3) are provided along the length of each rotating blade 43*a* and provided on the fixed blade 43*b*, such that ice may be ground therebetween.

As can be understood from FIG. 2, the guides 42*a*, 42*b* comprise a first guide 42*a* which is inclined downward from one side section of the case 41 to the grinder 43, and is formed by being extended to a distance from the grinder 43 and a second guide 42*b* which is inclined downward from the an opposing side section facing of the case 41 to the grinder 43 and is formed by extending to the adjacent location from the fixed blade 43*b*.

Referring to FIG. 2, the shutter 45 has a fixed length and is formed to have a curved portion according to a radius of rotation of the rotating blade 43*a*. The shutter 45 has one end being hinge-engaged adjacent to the first guide 42*a* to allow rotation towards the bottom of the case 41 in order to selectively open and close the diffuser 41*a*, and has another end that selectively contacts with the second guide 42*b* when the diffuser 41*a* is closed to prevent ice being discharged from the ice bin 40.

The bottom of the shutter 45 includes a coupling member 47 having certain dimensions and a coupling hole 47*a* formed therethrough, and one end of a control lever 46 which upwardly supports the shutter 45 is coupled in the coupling hole 47*a* to allow the shutter 45 to be opened or closed, and to maintain, the closed state of the diffuser 41*a*. The other end of the control lever 46 is inserted into a joint 48 that is securely attached to the case 41 and acts as the axis of rotation for the control lever 46 as shown in FIGS. 2 and 3.

In accordance with the related art structure, the ice sent into the ice bin 40 through the open upper potion thereof, is transferred to the grinder 43 by a spiral type auger 44 that rotates upon receiving power from a motor (not shown). Pieces of ice fall between the curved blade portions 43*c* of the rotating blade 43*a* (that rotates on the same axis as the auger 44) and the curved blade portions 43*c* of the fixed blade 43*b* that is fixed to the case 41, and the ice is thus ground (crushed) by the rotating power of the rotating blade 43*a*. As the rotating blade 43*a* rotates in the counterclockwise direction (when viewed along its axis as shown FIGS. 2 and 3), the control lever 46 is operated to pivot at its point of insertion at the joint 48, causing the shutter 45 connected to the control lever 46 (via the coupling hole 47*a* of the coupling member 47) to rotate in a clockwise direction (when viewed along its axis as shown FIGS. 2 and 3). Namely, the shutter 45 is "opened" due to the movement of the control lever 46 to allow the ice that was ground (crushed) by the rotating blade 43*a* and the fixed blade 43*b* to be discharged through the diffuser 41.

However, in such a conventional shutter open-close structure of an open type ice bin, during the ice grinding process of the grinder, it is problematic that the initial position of the shutter is pushed down due to fatigue load, because the shutter is pressed down while functioning as a guide to transfer ice after grinding (crushing).

BRIEF DESCRIPTION OF THE INVENTION

To achieve the purpose of the present invention, in an ice bin of a refrigerator, comprising: a case with an opened upper surface to receive a flow of ice and a diffuser at one side of the bottom thereof for externally discharging ice; an auger installed at the inside of the case for transferring the ice; guides for guiding the transferred ice; a grinding part for grinding the ice from the guides; and a shutter attached to one side of the case and capable of being rotated about a hinge portion to open and close the diffuser for selectively dispersing the ice externally from the case, whereby during the ice grinding process of said grinding part, a shutter open-close structure for preventing the shutter from being pushed down in the height-wise direction of the case is provided at one side of said case and comprises a shutter press prevention part.

DETAILED DESCRIPTION OF THE INVENTION

Hereinafter, the present invention is to be described in detail referring to the attached drawings.

One aspect of the present invention is that the present inventors recognized the drawbacks of the related art. Namely, an undesirable load is placed on the related art shutter mechanism of the ice bin in a refrigerator.

Figure 1:
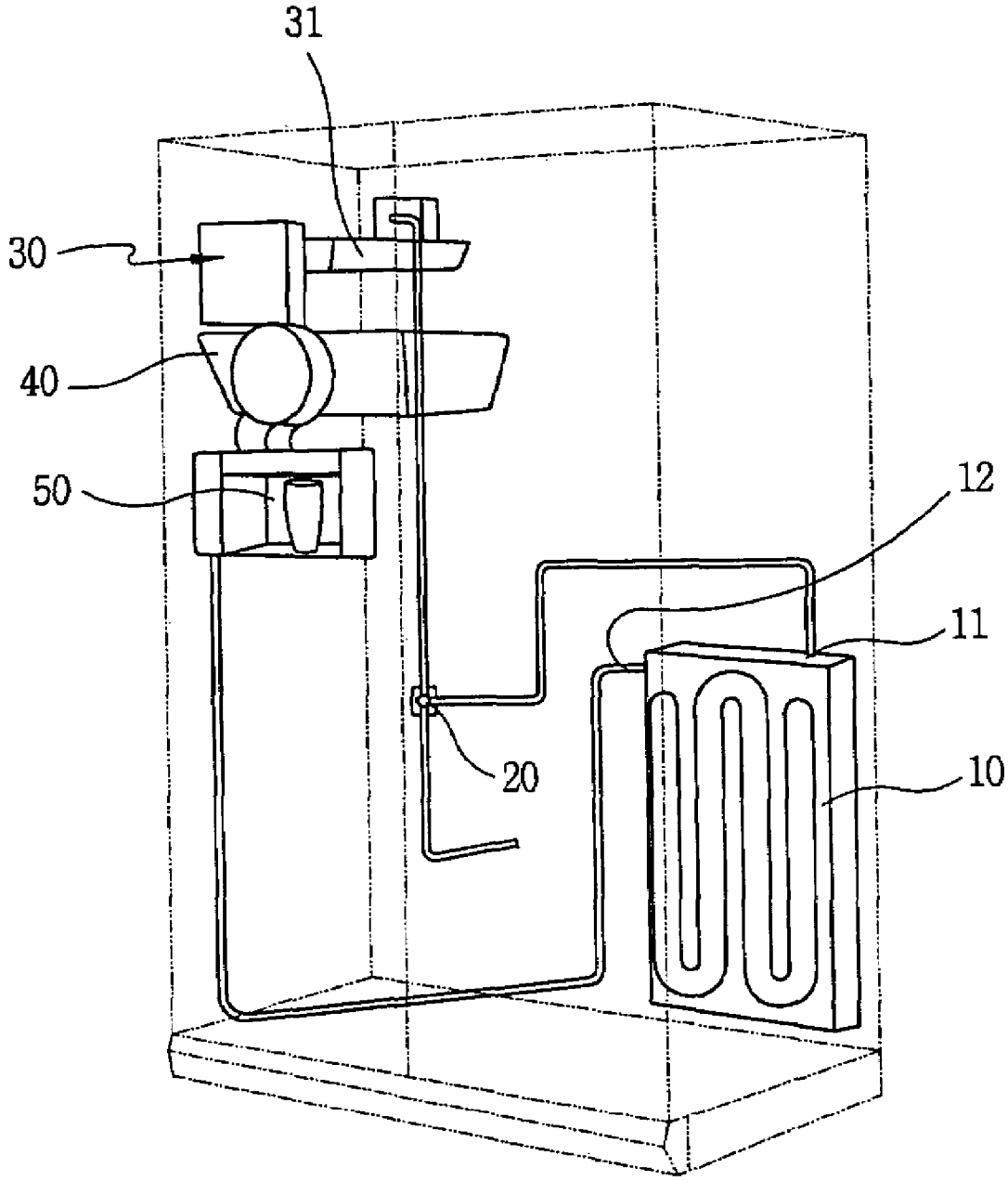
FIG. 1 CONVENTIONAL ART
FIG. 1 is a general view that illustrates the structure of a conventional art refrigerator.
Figure 2:
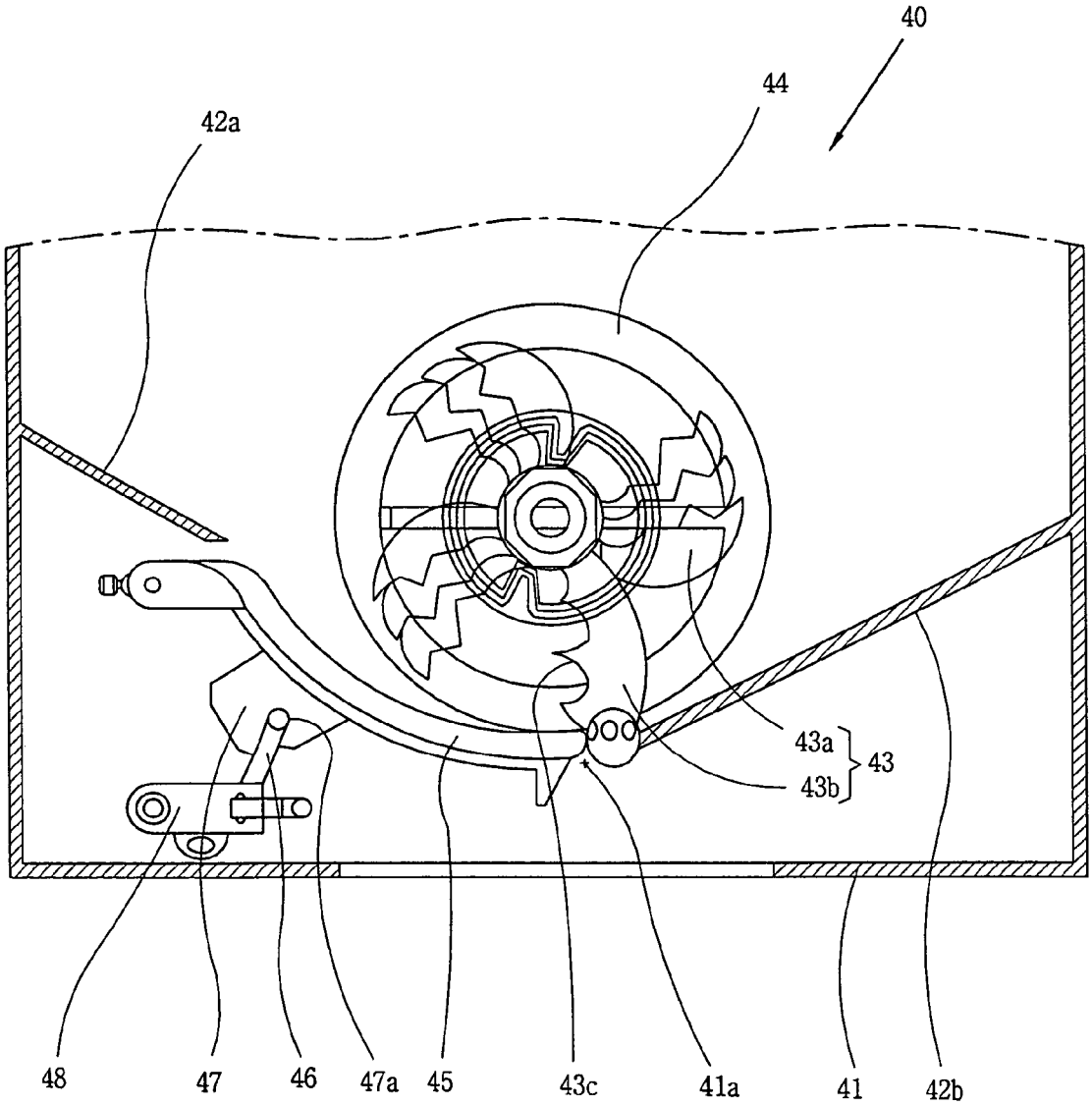
FIG. 2 CONVENTIONAL ART
FIG. 2 is a cross-sectional view that illustrates the structure of the open type ice bin of FIG. 1.
Figure 3:
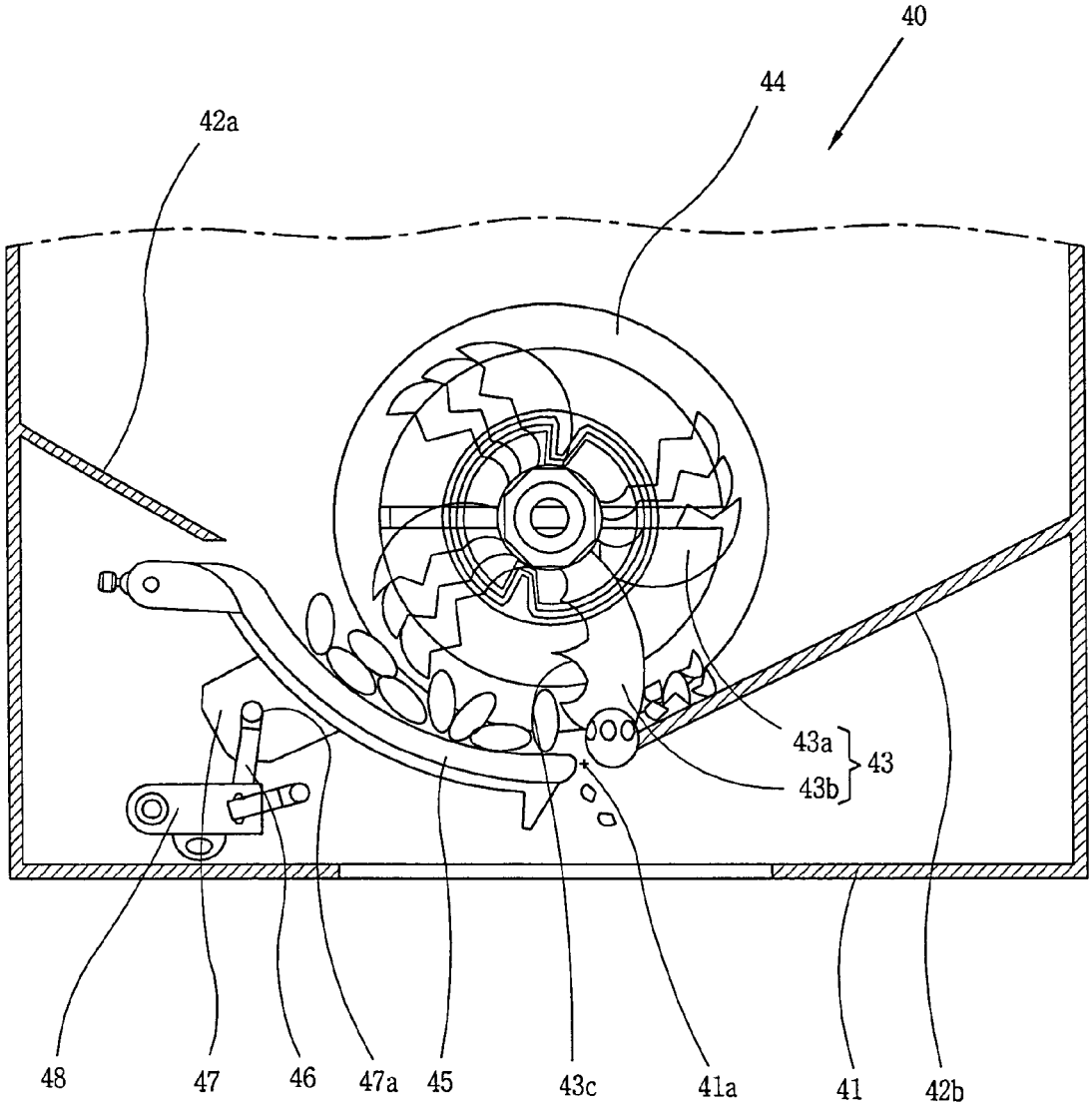
FIG. 3 CONVENTIONAL ART
FIG. 3 is a view of running mode state of FIG. 2.
Figure 4:
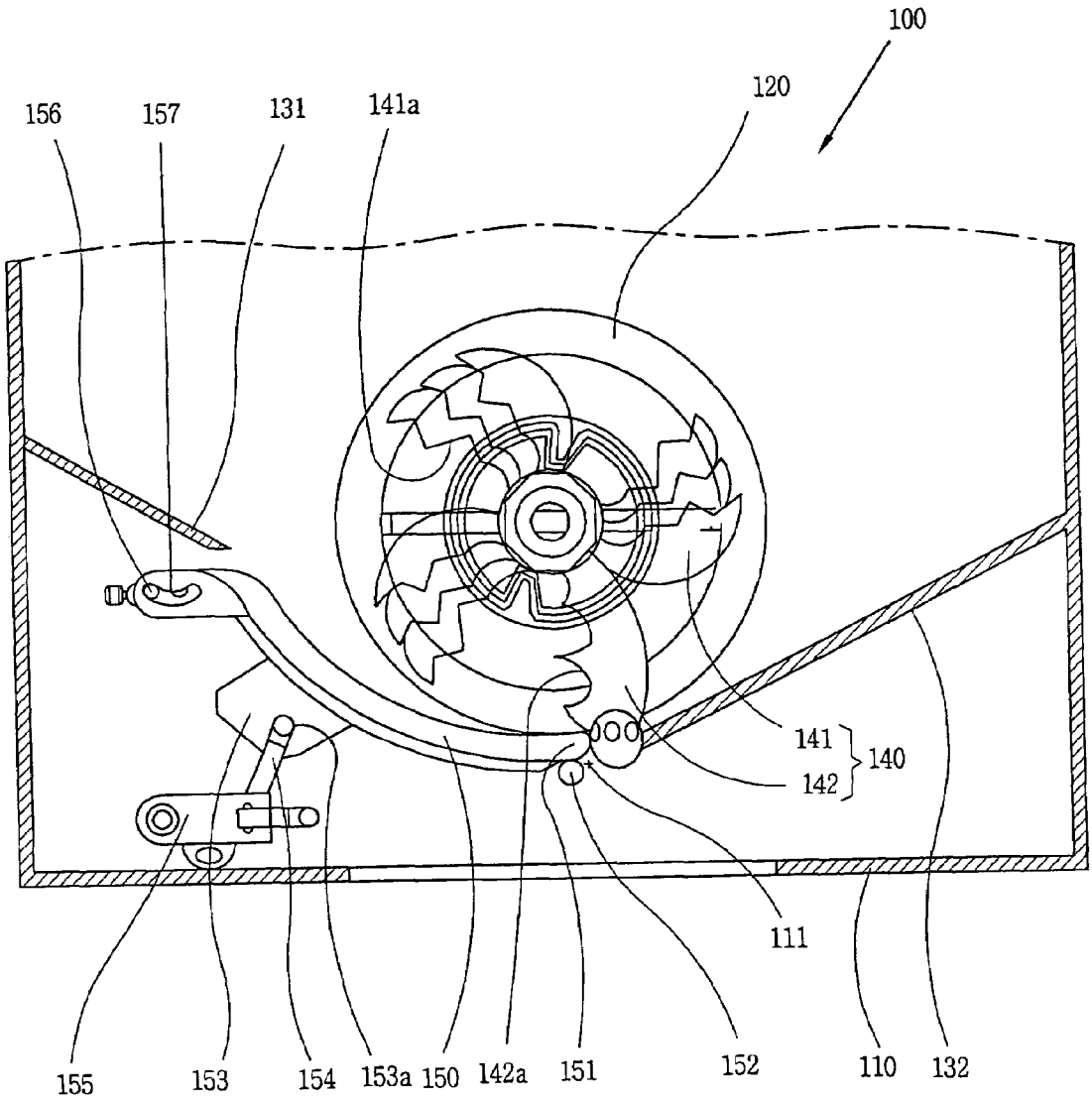
FIG. 4 is a cross-sectional view that illustrates an exemplary structure of the open-type ice bin according to an embodiment of the present invention.
Figure 5:
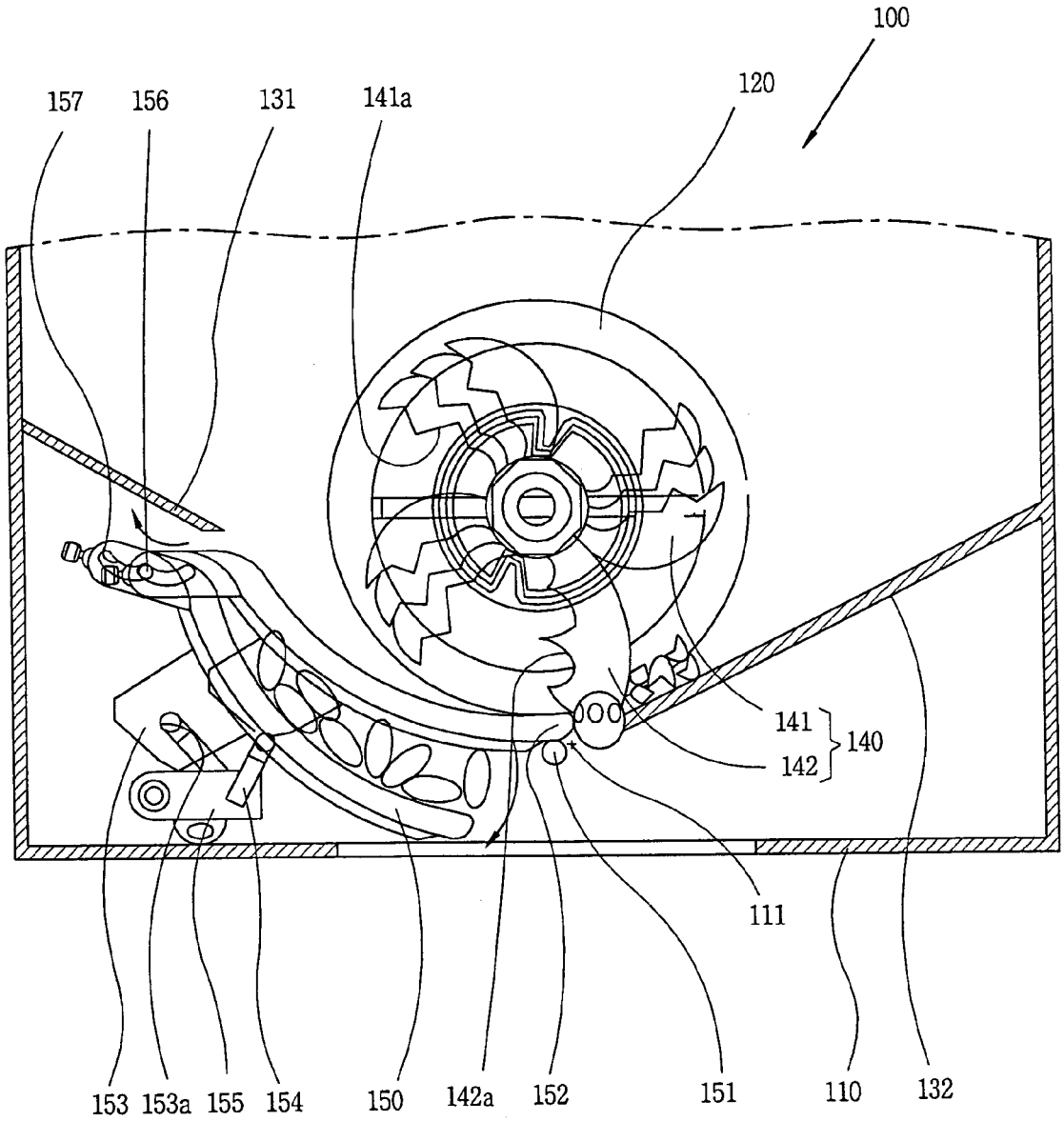
FIG. 5 is an operational view that illustrates an exemplary operation of the structure in FIG. 4.

FIG. 4 is a cross-sectional view that illustrates an exemplary structure of the open type (exposed) ice bin according to one embodiment of the present invention, and FIG. 5 is an operational view that illustrates the operation of FIG. 4.

As illustrated in the above-mentioned drawings, an ice bin 100 of a refrigerator may comprise: a case 110 with an open upper surface to receive ice (e.g., ice cubes, ice chips, etc.) therein and has a diffuser 111 (or disperser) at a bottom portion thereof for externally discharging ice; an auger 120 (or gimlet) installed within the case 110 for transferring the flow of ice; guides 131, 132 for guiding the transferred ice; a grinder 140 (or crusher) for grinding (or crushing) the ice that is guided by the guides 131, 132, and a shutter 150 (or other type of flap-like member) that opens and closes an outlet of the diffuser 111 for selectively dispersing the ice out of the case 110. The open-close structure of the open type ice bin in one embodiment of the present invention may comprise a shutter press prevention part (151 and 152; 153, 154, and 155, and 156 and 157) capable of preventing the shutter 150 from being undesirably pressed in the "downward" (vertical height-wise) direction of the case 110, which is achieved by urging the shutter 150 away from the grinder 140 during the ice grinding process.

The ice bin 100 may comprise: a case 110 with an open or exposed upper surface (or may be opened) for receiving ice (e.g., ice cubes, ice chips, etc.) therein and has a diffuser 111 (disperser) at a bottom portion thereof for externally discharging ice; a spiral type auger 120 (or gimlet) installed within the case 110 for transferring the flow office; guides 131, 132 for guiding the transferred ice; a grinder 140 (crusher) for grinding (crushing) the ice guided by the guides 131, 132; and a shutter 150 (or other type of flap-like member) that opens and closes an outlet of the diffuser 111 for selectively dispersing the ice out of the case 110.

A cross section of the case 110 may be formed as a rectangular shape, and the grinder 140 may be located at or near a relatively center portion at the bottom of the case 110. The guides 131, 132 are inclined "downward" to the grinder 140 as extensions from opposing internal walls of the case 110, and the grinder 140 and the guides 131, 132 are arranged to have a certain gap therebetween, to allow space for grinding (crushing) the ice that drops or down falls into the grinder 140.

The grinder 140 may comprise: a rotating blade 141 which is rotated on the same axis with the auger 120; a fixed blade 142 which is fixed and arranged at a relatively perpendicular manner (at a right angle) with the bottom surface of the case 110; and multiple blades with inwardly curved portions formed along the length (or wing) of each rotating blade 141 and fixed blade 142 for grinding (crushing) the ice.

The guides 131, 132, may comprise: a first guide 131 which is inclined "downward" from one side of the case 110 extending towards the grinder 140; and a second guide 132 which is inclined "downward" from the opposing side of the to case 110 extending towards the grinder 140 and an end portion of the second guide 132 is adjacent to or connected with the fixing blade 142.

A shutter 150 may be formed to have a curvature of certain length according to a radius of rotation of the rotating blade 141. A first end of the shutter 150 may be engaged with a "sliding hinge" (i.e., 156 and 157: or other mechanism allowing sliding and pivoting movements for the shutter 150) at or near the first guide 131, allowing the shutter 150 to not only rotate when selectively opening, and closing the diffuser 111, but also to slide away from the grinder 140. The second end of the shutter 150 (which opposes the first end) operatively contacts with an end of the second guide 132, when the diffuser 111 is closed to prevent ice from discharging.

The first end of the shutter 150 may have a curved slot (or curved opening) that receives a projected hinge axis 156 (having a certain protrusion length according to the thickness of the case 110) formed at an inner surface of the case 110.

The bottom of the shutter 150 includes a coupling member 153 having certain dimensions and a coupling hole 153*a* formed therethrough, and one end of a control lever 154 which upwardly supports the shutter 150 is coupled in the coupling hole 153*a* to allow the shutter 150 to be opened or closed, and to maintain the closed state of the diffuser 111. The other end of the control lever 154 is inserted into a joint 155 that is securely attached to the case 110 and acts as the axis of rotation for the control lever 46 as shown in FIGS. 4 and 5.

A spring or other elastic member (not shown) wherein one end is coupled to the joint 155 and the other end is coupled to the control lever 154 may be installed at the hinge coupling part of the joint 155 and the control lever 154 for returning the shutter 150 to its closed position.

The shutter press prevention part may comprise: a hitch jaw 151 formed at an end portion of the shutter 150; and a hitch projection 152 projected at a certain length according to the thickness of the case 110 at a surface thereof and contacted with the hitch jaw 151.

In accordance with such construction, the ice (e.g., ice cubes, ice chips, etc.) received through the open (or exposed) upper portion of ice bin 100 is transferred to the grinder 140 (crusher) by the spiral type auger 120 (or gimlet) that rotates upon receiving power from a motor (not shown). The transferred ice falls between the curved blade portions 141*a* of the rotating blade 141 that is rotated on the same axis with the auger 120 and the blade portion 142*a* of the fixed blade 142 mounted in the case 110, and is ground (crushed) by the rotating power of the rotating blade 141. During the grinding (crushing) of ice, pressure is applied onto the shutter 150, which supports the ice, but the present invention securely maintains the shutter 150 in its closed state (i.e., the diffuser 111 is closed) because the fixed hitch projection 152 coupled to the case 110 sufficiently supports the hitch jaw 151 that is formed at one end of the shutter 150. Namely, the shutter 150 having the hitch jaw 151 can be sufficiently supported by the fixed hitch projection 152, and can bear the weight on the ice being supported, as well as the force and pressure applied from the grinder 140 during the ice grinding (crushing) operation.

During the diffusion (dispersion) of the crushed (ground) ice, if the control lever 154 is moved (i.e., pivots on the joint 155), the shutter 150 slides laterally on the hinge axis 156 via the (curved) hinge opening 157 to thus force the hitch jaw 151 to separate from the hitch projection 152. As the control lever 154 continues to pivot further, the shutter 150 (connected to the control lever 154 through the coupling member 153) is rotated (opened) and the diffuser 111 outlet is opened to thereby allow crushed ice to exit therethrough.

Upon completing the diffusion (dispersion) of ice, if the control lever 154 is moved back to its original position, the shutter 150 closes the diffuser 111 outlet, and as the control lever 154 continues to pivot, the shutter 150 slides laterally on the hinge axis 156 via the (curved) hinge opening 157 to thus force the hitch jaw 151 to lock together with the hitch projection 152, and thereby the shutter 150 is returned to its closed position that securely supported.

The present invention provides an ice dispenser apparatus comprising: a container to hold pieces of ice therein; an ice crusher to crush the ice pieces in the container; and a shutter mechanism to dispense the crushed ice from the container and being sufficiently supported during an operation of the ice crusher.

The shutter mechanism may comprise: a shutter having a first end, and a second end with a hitch jaw opposing the first end; a sliding hinge at the first end of the shutter; and an actuator cooperating with the shutter and the sliding hinge to open the shutter when dispensing the crushed ice and to close the shutter in a sufficiently supported manner using the hitch jaw.

Here, the actuator may open the shutter by initially moving the shutter in a lateral direction along the sliding hinge to allow the hitch jaw to disengage from a hitch protrusion of the container, and to then allow the shutter to open by rotation about the sliding hinge; and may close the shutter by initially allowing the shutter to close by rotation about the sliding hinge, and then moving the shutter in a lateral direction along the sliding hinge to allow the hitch jaw to engage and lock with a hitch protrusion of the container.

The sliding hinge may comprise: the first end of the shutter with a curved slot; and a protrusion engaging with the curved slot that allows the shutter to rotate at each end of the curved slot and to move in a lateral direction between the ends of and along the curved slot.

The actuator may comprise a joint and lever mechanism operatively connected to a bottom portion of the shutter.

A guide mechanism with guide walls and a gimlet to transfer the ice pieces in the container to the ice crusher may also be further used.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art. In the claims, means-plus-function clauses are intended to cover the structure described herein as performing the recited function and not only structural equivalents but also equivalent structures.

What is claimed is:

1. An ice bin apparatus, comprising:

a case with an open upper portion that receives pieces of ice;

a guide within the case that guides the received ice pieces;

an auger adjacent to the guide that transfers the guided ice pieces;

a grinder that grinds the transferred ice pieces;

a diffuser located at a bottom portion of the case that discharges the ground ice;

a shutter having a hinge that allows movement thereof to open or close the diffuser for selectively discharging the ground ice therethrough;

a shutter press prevention part capable of preventing the shutter from being pressed down during the grinding of ice pieces performed by the grinder; and an open-close control part, capable of controlling an opening and closing of the shutter, installed at one side of the shutter and comprising a coupled member formed at a bottom section of the shutter, a joint formed at one side of the case and a control lever extended at a length by bending one end hinge-engaged to one side of said joint.

2. The apparatus of claim 1, wherein said shutter further comprises:

a hitch jaw extended at a certain length from one end of the shutter; and a hitch projection formed at a surface of the case and operatively contacts with the hitch jaw.

3. The apparatus of claim 2, further comprising:

a projected hinge axis having a length according to a thickness of the case at the hinge part to be capable of moving a certain distance according to the surface of the case and the shutter to which a hinge hole engaging with the hinge axis by having a certain length and being bent is penetrated.

4. The apparatus of claim 1, wherein the open-close part further comprises a twisted spring, with one end coupled to the joint and the other end coupled to the control lever, installed at the hinge coupling part of the joint and the control lever that returns the shutter to its original position.

5. The apparatus of claim 4, further comprising:

a projected hinge axis having a length according to a thickness of the case at the hinge part to be capable of moving a certain distance according to the surface of the case and the shutter to which a hinge hole engaging with the hinge axis by having a certain length and being bent is penetrated.

6. An ice bin apparatus, comprising:

a case with an open upper portion that receives pieces of ice;

a guide within the case that guides the received ice pieces;

an auger adjacent to the guide that transfers the guided ice pieces;

a grinder that grinds the transferred ice pieces;

a diffuser located at a bottom portion of the case that discharges the ground ice;

a shutter having a hinge that allows movement thereof to open or close the diffuser that selectively discharges the ground ice therethrough;

a shutter press prevention part capable of preventing the shutter from being pressed down during the grinding of ice pieces performed by the grinder; and an open-close control part, capable of controlling an opening and closing of the shutter, installed at one side of the shutter, and comprising a coupled member formed at a bottom section of the shutter, a joint formed at one side of the case, and a control lever extended at a length by bending one end hinge-engaged to one side of said joint.

7. The apparatus of claim 6, wherein the open-close control part further comprises a twisted spring, with one end coupled to the joint and the other end coupled to the control lever, installed at the hinge coupling part of the joint and the control lever that returns the shutter to its original position.

8. The apparatus of claim 7, further comprising:

a projected hinge axis having a length according to a thickness of the case at the hinge part to be capable of moving a certain distance according to the surface of the case and the shutter to which a hinge hole engaging with the hinge axis by having a certain length and being bent is penetrated.

9. An ice dispenser apparatus comprising:

a container to hold pieces of ice therein;

an ice crusher to crush the ice pieces in the container;

a shutter mechanism to dispense the crushed ice from the container and being sufficiently supported during an operation of the ice crusher, and an actuator comprising a joint and lever mechanism operatively connected to a bottom portion of the shutter to open the shutter when dispensing the crushed ice and to close the shutter when the ice pieces are crushed, wherein the shutter mechanism comprises: a shutter having a first end and a second end with a hitch jaw opposing the first end; and a sliding hinge at the first end of the shutter, and wherein the actuator cooperates with the shutter and the sliding hinge to close the shutter in a sufficiently supported manner using the hitch jaw.

10. The apparatus of claim 9, wherein the actuator, opens the shutter by initially moving the shutter in a lateral direction along the sliding hinge to allow the hitch jaw to disengage from a hitch protrusion of the container, and to then allow the shutter to open by rotation about the sliding hinge; and closes the shutter by initially allowing the shutter to close by rotation about the sliding hinge, and then moving the shutter in a lateral direction along the sliding hinge to allow the hitch jaw to engage and lock with a hitch protrusion of the container.

11. The apparatus of claim 9, wherein the sliding hinge comprises:

the first end of the shutter with a curved slot; and a protrusion engaging with the curved slot that allows the shutter to rotate at each end of the curved slot and to move in a lateral direction between the ends of and along the curved slot.

12. The apparatus of claim 9, further comprising:

a guide mechanism with guide walls and a gimlet to transfer the ice pieces in the container to the ice crusher.

* * * * *